US005531416A

United States Patent [19]

Remmers

[11] Patent Number: 5,531,416

[45] Date of Patent: Jul. 2, 1996

[54] CONTINUOUS SLIDE BRACKET

[75] Inventor: Lee Remmers, Ocala, Fla.

[73] Assignee: Clairson, Inc., Newark, Del.

[21] Appl. No.: 315,917

[22] Filed: Sep. 30, 1994

[51] Int. Cl.[6] ..... A47F 5/00

[52] U.S. Cl. ..... 248/222.51; 211/105.1; 211/162; 248/201; 248/304

[58] Field of Search ..... 248/220.2, 222.2, 248/251, 304, 305, 317, 339, 340, 201; 211/90, 94, 105.1, 106, 123, 162, 181

[56] References Cited

U.S. PATENT DOCUMENTS

| | | | |
|---|---|---|---|
| 3,141,556 | 7/1964 | Klosterman | 211/162 |
| 3,784,023 | 1/1974 | Varon et al. | 211/105.1 |
| 3,972,499 | 8/1976 | Simmons | 248/304 X |
| 4,340,144 | 7/1982 | Cousins | 211/106 X |
| 4,671,419 | 6/1987 | Beverly | 211/105.1 |
| 4,842,230 | 6/1989 | Cobb et al. | 211/106 X |
| 5,050,750 | 9/1991 | Mason | 211/105.1 X |
| 5,350,072 | 9/1994 | Rogers et al. | 211/94 X |
| 5,405,026 | 4/1995 | Lee et al. | 211/106 X |

FOREIGN PATENT DOCUMENTS

| | | | |
|---|---|---|---|
| 2439143 | 2/1976 | Germany | 248/251 |

*Primary Examiner*—Alvin C. Chin-Shue
*Assistant Examiner*—Derek J. Berger
*Attorney, Agent, or Firm*—Middleton & Reutlinger; Charles G. Lamb

[57] ABSTRACT

A J-shaped slide bracket for receiving a hanger rod particularly for clothes includes a pair of hooks mounted on an upper portion of the bracket wherein the hooks are sized and spaced apart to receive a pair of shelf rods or wires therein. The J-shaped bracket terminates at its lower portion with a U-shaped cradle sized to receive a hanger rod therein, particularly one for clothes hangers.

15 Claims, 2 Drawing Sheets

CONTINUOUS SLIDE BRACKET

BACKGROUND OF THE INVENTION

The invention relates to attachments to shelves for holding other objects thereon. More particularly, the present invention relates to a bracket which is mounted to the rods of a shelf, the bracket being provided with means to receive a rod member thereon, the rod member being particularly useful for receiving clothes hangers.

In the manufacture of shelves for closets, a number of types of shelves are made for being attached to the walls of the closets by wall brackets. Many of these shelves are comprised of parallel wires or rods extending longitudinally of the closet, as well as other wires which run transverse of the closet which add strength and support to the longitudinally extending wires. Moreover, there are a number of attachments which are made for being hooked to these shelf wires which add for additional versatility of these closet shelves.

SUMMARY OF THE INVENTION

In the present invention, it is recognized that it is desirable to provide for adding versatility to a closet by adding a bracket for slidable detachable connection to support wires of a wire shelf whereby the bracket includes a cradle at its lower extremity for receiving a longitudinally extending rod.

It is further recognized that it is desirable to provide a bracket attachment for the wires of a closet shelf whereby the bracket has means to receive a clothes hanger rod therein.

Even further, it is recognized that it is desirable to provide a slidable bracket for a closet shelf which has means therein to receive clothes hangers thereon.

The present invention advantageously provides a straight forward arrangement for the preparation of an improved continuous slide bracket for clothes hangers whereby clothes hangers may be slidably received upon a longitudinally extending rod received within the continuous slide bracket.

The present invention further provides a bracket for attachment to the longitudinally extending wires of a wire shelf at its upper extremity and at its lower extremity includes a U-shaped cradle therein for receiving a longitudinally extending clothes hanger rod therein.

Various other features of the present invention will become obvious to those skilled in the art upon reading the disclosure set forth hereinafter.

More particularly, the present invention provides a continuous slide bracket for a hanger rod comprising:

a body;

a pair of hooks mounted on an upper portion of said body and spaced on opposite sides of said body, each of said hooks being sized to receive a shelf wire therein; and, an upwardly extending U-shaped cradle on a lower portion of said body sized to receive a hanger rod therein.

It is to be understood that the description of the examples of the present invention given hereinafter, are not by way of limitation. Various modifications within the scope of the present invention will be apparent to those skilled in the art upon reading the disclosure set forth hereinafter.

BRIEF DESCRIPTION OF THE DRAWINGS

Referring to the drawings.

DETAILED DESCRIPTION OF THE PREFERRED EMBODIMENT

Figure 1:
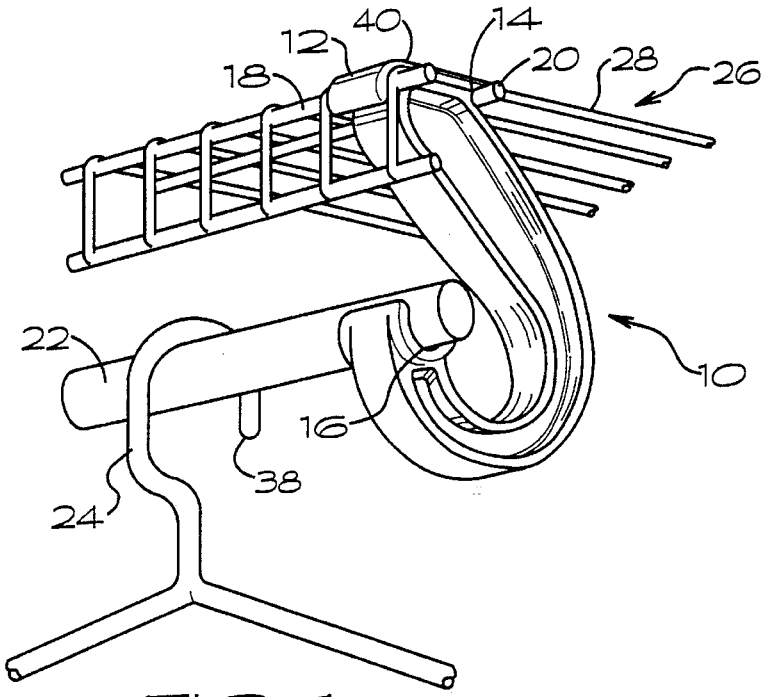
FIG. 1 is a perspective view of a continuous slide bracket of the present invention attached to a wire shelf with a clothes hanger rod received by the bracket.

As shown in FIG. 1, a continuous slide bracket 10 of the present invention is attached to a wire shelf 26 and is particularly useful for receiving a clothes hanger rod 22 thereon. Wire shelf 26 is generally comprised of a plurality of longitudinally extending wires, only two being shown in FIG. 1, and identified by the numeral 18 for the front wire of the shelf and by the numeral 20 for an intermediate wire of the shelf. Transverse wires 28 are also provided for support for the wire shelf 26 and the transversely extending wires 28 extend from the back of the shelf to the front of the shelf and over the front wire 18 and downwardly therepast.

Figure 2:
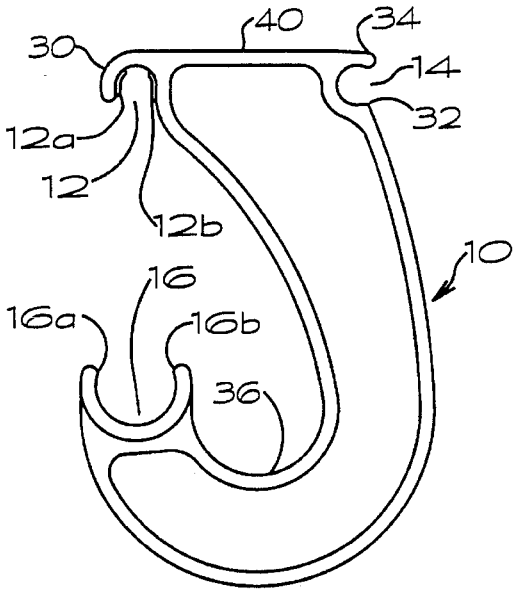
FIG. 2 is a side view of the continuous slide bracket of FIG. 1.
Figure 4:
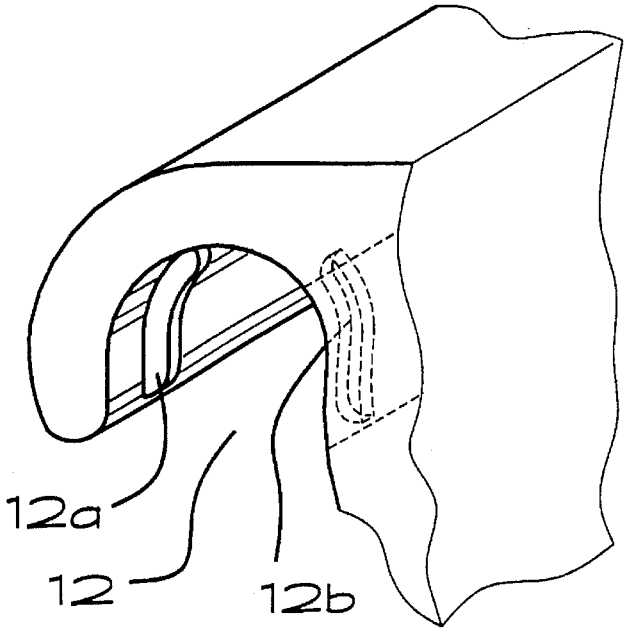
FIG. 4 is an enlarged partial perspective view of a front hook of a continuous slide bracket of FIG. 1; and, FIG. 5 is an enlarged side view of one element of a continuous slide bracket as shown in FIG. 2.

The continuous slide bracket 10 is provided with a front hook 12 which is generally of arcuate shape with the radius of curvature of the hook 12 being substantially the same as the radius of curvature of the front wire 18. The front hook 12 is provided with a downwardly extending lip portion 30 which, as best shown in FIG. 2, extends downwardly and upon positioning on the wire 18 (FIG. 1), the hook 12 is maintained in place. In one preferred embodiment, as best shown in FIG. 4, ribs 12*a* and 12*b* (shown in phantom lines) are on opposite sides thereof. Even though only one rib 12*a* and one rib 12*b* are shown, it is realized that ribs 12*a* and 12*b* may be spaced at preselected distances all along hook 12. Ribs 12*a*, 12*b* allow for manufacturing tolerances and still allow a tight fit for hook 12 with wire 18. Furthermore, even though two ribs 12*a*, 12*b*, are shown in spaced alignment on opposite arcuate segments of front hook 12, it is realized that ribs 12*a*, 12*b* may be spaced in non-alignment in front hook 12. Also, it is realized that in some applications, only one rib 12*a* or 12*b* may be used.

Figure 3:
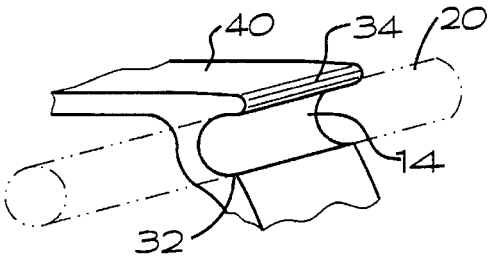
FIG. 3 is a partial perspective view of a back hook of the continuous slide bracket of FIG. 1.

As best shown in FIG. 3 on the back side of the bracket is a back hook 14 which is also of generally arcuate shape and is approximately the same size as the radius of curvature of the intermediate wire 20. The back hook 14 opens outwardly away from the slide bracket 10 and the back hook 14 is provided with an outwardly extending lip portion 34 which extends generally horizontal outwardly from the back portion of the bracket 10 and a rib portion 32 which extends upwardly on the opposite side of the lip 34. The opening between the rib 32 and the lip 34 is slightly less than the diameter of the wire 20. The continuous slide bracket 10 is generally made of a resilient plastic material so that the back hook 14, upon engaging with the wire 20, forces the lip 34 away from the rib 32 and thereby once the wire 20 is received within the hook 14, the lip 34 in cooperating relation with the rib 32, holds the wire 20 intact.

Figure 5:
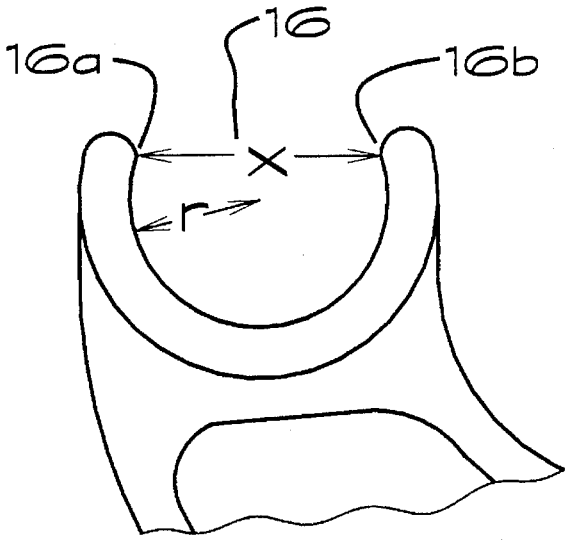

In a preferred embodiment, a continuous slide bracket has a body of J-shaped configuration and the front hook 12 and back hook 14 are at the top of the J and a U-shaped cradle 16 is provided at the lower terminating end of the bracket. The U-shaped cradle 16 opens upwardly and has a radius of curvature substantially the same as a clothes hanger rod 22 (FIG. 1) received therein. However, as best shown in FIG. 5, cradle 16 is provided with tip ends 16*a* and 16*b* wherein the distance "X" between the tip ends 16*a*, 16*b* is less than the diameter of the rod 22 which is received within cradle 16. This allows means for rod 22 to be "snapped" into cradle 16. For example, for a radius of curvature r being 0.372 inches the distance X would be less than 2 times r, such as, x being 0.728 inches. Also, as best shown in FIG. 2, the central axis of the U-shaped cradle 16 is in vertical alignment with the central axis of the front hook 12 so that the U-shaped cradle 16 is substantially vertically aligned with the front hook 12. Moreover, the J-shaped bracket 10 is provided with a lower curved portion wherein the lower curved portion 36 has a depth greater than the terminating end 38 of a hanger 24 (FIG. 1) which is slidably received upon the clothes hanger rod 22. Thus, the clothes hanger 24 can slide past and over the J-shaped slide bracket 10 when in use. As shown in FIG. 1, the top 40 of the bracket 10 is of substantially the same width as the spacing between two transversely extending wires 28 of the wire shelf 26 and the distance between the front hook 12 and the back 14 is generally the same spaced distance as between a front wire 18 of the wire shelf 26 and the first intermediate wire 20 of the shelf 26.

In operation, the J-shaped bracket 10 is configured so that the upper end of the bracket, including the top 40, is inserted angularly up between the front wire 18 and the first intermediate wire 20 with the front hook 12 engaging with the wire 18 and the back hook 14 being snapped onto the intermediate wire 20. A second J-shaped slide bracket is generally then placed at a preselected distance along the wire shelf spaced from the first J-shaped slide bracket and the front and back hooks 12 and 14, respectively, are snapped in position as previously described. After two J-shaped slide brackets have been positioned at preselected locations along the wire shelf 26, a hanger rod 22 is then placed within the U-shaped cradles 16 of the brackets 10. Furthermore, a plurality of J-shaped brackets 10 may be spaced along the shelf 26 and a plurality of rods 22 may be placed end to end longitudinally therealong.

It will be realized that various changes may be made to the specific embodiment shown and described without departing from the scope and spirit of the present invention.

What is claimed is:

1. A continuous slide bracket for a hanger rod comprising:

a body of J-shaped configuration having a downward terminating end including a U-shaped cradle for receiving a hanger rod therein;

a pair of hooks mounted on an upper portion of said body and spaced on opposite sides of said body, each of said hooks being sized to receive a shelf wire therein.

2. The bracket of claim 1, wherein said body includes a lower-portion having a recess therein with a depth and width sufficient for clothes hangers to pass thereacross.

3. The bracket of claim 1, said U-shaped cradle being in vertical alignment with one of said hooks.

4. The bracket of claim 1, said U-shaped cradle having opposed tip ends wherein the spacing between the tip ends is less than a diameter of said cradle.

5. The bracket of claim 1, said pair of hooks comprising a front hook and a back hook, said front hook being of arcuate configuration with an opening in a lower portion thereof and said back hook being of arcuate configuration with an opening horizontally outward from said bracket.

6. The bracket of claim 5, said front hook including one circumferential rib therein.

7. The bracket of claim 1, said front hook including at least one pair of circumferential ribs, said ribs being spaced on opposite arcuate segments of said front hook.

8. The bracket of claim 7, said ribs being in spaced alignment.

9. A continuous slide bracket for a hanger rod comprising:

a body;

a pair of hooks mounted on an upper portion of said body and spaced on opposite sides of said body, each of said hooks being sized to receive a shelf wire therein, said pair of hooks comprising a front hook and a back hook, said front hook being of arcuate configuration with an opening in a lower portion thereof and said back hook being of arcuate configuration with an opening horizontally outward from said bracket; and, an upwardly extending U-shaped cradle on a lower portion of said body sized to receive a hanger rod therein.

10. The bracket of claim 1, said body being of J-shaped configuration.

11. The bracket of claim 9, said front hook including one circumferential rib therein.

12. The bracket of claim 9, said front hook including at least one pair of circumferential ribs, said ribs being spaced on opposite arcuate segments of said front hook.

13. The bracket of claim 12, said ribs being in spaced alignment.

14. The bracket of claim 9, said body being of J-shaped configuration.

15. The bracket of claim 14, said Body including a lower portion having a recess therein with a depth and width sufficient for clothes hangers to pass thereacross.

* * * * *